US011241722B2

(12) United States Patent
Tomkins

(10) Patent No.: US 11,241,722 B2
(45) Date of Patent: Feb. 8, 2022

(54) METHOD AND SYSTEM FOR REMOVING HYDROCARBON DEPOSITS FROM HEAT EXCHANGER TUBE BUNDLES

(71) Applicant: T5 Technologies, Inc., Edmonton (CA)

(72) Inventor: Michael Tomkins, Sherwood Park (CA)

(73) Assignee: T5 TECHNOLOGIES, INC.

( * ) Notice: Subject to any disclaimer, the term of this patent is extended or adjusted under 35 U.S.C. 154(b) by 414 days.

(21) Appl. No.: 15/817,931

(22) Filed: Nov. 20, 2017

(65) Prior Publication Data

US 2018/0071793 A1 Mar. 15, 2018

Related U.S. Application Data

(63) Continuation of application No. 13/414,177, filed on Mar. 7, 2012, now abandoned.

(51) Int. Cl.
*B08B 3/10* (2006.01)
*B08B 3/14* (2006.01)
(Continued)

(52) U.S. Cl.
CPC ..... *B08B 3/10* (2013.01); *B08B 3/14* (2013.01); *B08B 9/023* (2013.01); *B08B 9/027* (2013.01); *F28G 9/00* (2013.01)

(58) Field of Classification Search
None
See application file for complete search history.

(56) References Cited

U.S. PATENT DOCUMENTS 2,112,896 A 4/1938 Husband
3,214,867 A 11/1965 Henning
(Continued)

FOREIGN PATENT DOCUMENTS

CA 2137767 12/1993
DE 19725631 3/1999
(Continued)

OTHER PUBLICATIONS

Extended European Search Report for EP 13756992, dated Nov. 12, 2015, 9 pages.
(Continued)

*Primary Examiner* — Rita P Adhlakha
(74) *Attorney, Agent, or Firm* — McAndrews, Held & Malloy, Ltd.

(57) ABSTRACT

A method and system for removing hydrocarbon deposits from a heat exchanger tube bundle using an organic solvent. After contact with a heat exchanger tube bundle, the contaminated organic solvent may be treated to remove solids, base waters, and/or suspended hydrocarbons, and then again contacted with a heat exchanger tube bundle for the removal of hydrocarbon deposits. This allows for the removal of hydrocarbon deposits from a heat exchanger tube bundle in an efficient and environmentally friendly manner. The treatment of the heat exchanger tube bundle is also preferably performed using a method and system by which, through contact of the heat exchanger tube bundle with an organic solvent, a large percentage of hydrocarbon deposits are removed from the heat exchanger tube bundle in a short period of time.

18 Claims, 8 Drawing Sheets

(51) Int. Cl.

| | |
|---|---|
| ***F28G 9/00*** | (2006.01) |
| ***B08B 9/023*** | (2006.01) |
| ***B08B 9/027*** | (2006.01) |

(56) References Cited

U.S. PATENT DOCUMENTS

| | | | | |
|---|---|---|---|---|
| 3,225,777 | A | 12/1965 | Shelton et al. | |
| 3,703,905 | A | 11/1972 | Ice, Jr. | |
| 4,288,329 | A | 9/1981 | Duval | |
| 4,509,544 | A | 4/1985 | Mains, Jr. | |
| 4,511,537 | A | 4/1985 | Fiocco et al. | |
| 4,747,948 | A | 5/1988 | North | |
| 5,018,544 | A | 5/1991 | Boisture et al. | |
| 5,080,721 | A | 1/1992 | Flanigan et al. | |
| 5,173,122 | A * | 12/1992 | Tilby | A23N 12/023 127/2 |
| 5,248,343 | A | 9/1993 | Hamilton et al. | |
| 5,323,529 | A * | 6/1994 | Amuny | B23P 19/024 29/723 |
| 5,349,974 | A | 9/1994 | Mansur | |
| 5,425,814 | A | 6/1995 | Krajicek et al. | |
| 5,437,296 | A | 8/1995 | Citino | |
| 5,499,639 | A | 3/1996 | Williams, Jr. | |
| 6,196,301 | B1 | 3/2001 | Sabin | |
| 6,283,133 | B1 | 9/2001 | Furuta et al. | |
| 6,308,774 | B1 * | 10/2001 | Kramer | F22B 37/003 165/95 |
| 6,423,152 | B1 | 7/2002 | Landaas | |
| 6,644,326 | B2 | 11/2003 | Dorton et al. | |
| 6,681,839 | B1 | 1/2004 | Balzer | |
| 6,936,112 | B2 | 8/2005 | Jansen et al. | |
| 7,055,580 | B2 | 6/2006 | Schildmann et al. | |
| 7,531,065 | B2 | 5/2009 | Yamamoto | |
| 2004/0102351 | A1 | 5/2004 | Jansen et al. | |
| 2006/0185691 | A1 * | 8/2006 | Joseph | B08B 3/02 134/22.1 |
| 2008/0149475 | A1 | 6/2008 | Yamamoto et al. | |
| 2009/0255557 | A1 * | 10/2009 | Gardner | B08B 9/04 134/18 |
| 2009/0320877 | A1 | 12/2009 | Bradley | |
| 2010/0059091 | A1 | 3/2010 | Meissner | |
| 2010/0294317 | A1 * | 11/2010 | Dufrene | B01D 21/10 134/22.18 |
| 2010/0307536 | A1 | 12/2010 | Nath et al. | |
| 2012/0024321 | A1 * | 2/2012 | Hays | B08B 3/02 134/10 |
| 2013/0031960 | A1 * | 2/2013 | Delrahim | F01D 11/06 73/40.5 R |
| 2013/0233350 | A1 * | 9/2013 | Tomkins | B08B 9/023 134/12 |

FOREIGN PATENT DOCUMENTS

| | | | | |
|---|---|---|---|---|
| GB | 467208 | | 6/1937 | |
| GB | 467208 | A * | 6/1937 | F28B 9/00 |

OTHER PUBLICATIONS

International Search Report and Written Opinion for PCT/CA2013/000207, dated Jul. 9, 2013, 12 pages.

* cited by examiner

METHOD AND SYSTEM FOR REMOVING HYDROCARBON DEPOSITS FROM HEAT EXCHANGER TUBE BUNDLES

This application is a continuation of U.S. patent application Ser. No. 13/414,177, filed Mar. 7, 2012, the entirety of which is incorporated by reference herein.

BACKGROUND OF THE INVENTION

Field of the Invention

The present invention relates generally to a method and system for removing hydrocarbon deposits from heat exchanger tube bundles. More particularly, an aspect of the present invention relates to a method and system for thoroughly and efficiently cleaning heat exchanger tube bundles while minimizing the environmental impact of the cleaning process.

Description of the Related Art

Heat exchanger tubes bundles are used in chemical processes to either raise or lower the temperature of a fluid. They are heavily used in the oil and gas industry, such as by refineries, up-graders, and gas plants. During use, carbonaceous deposits including heavy oil, bitumen, and other hydrocarbons can form on the tube bundles, reducing the effectiveness of the heat exchanger and forcing the operator to consume more energy to achieve the desired degree of temperature change. Accordingly, in order to maintain an efficient operation of the heat exchanger, it is necessary to periodically remove the fouled tube bundles and clean them of hydrocarbon deposits.

Current methods for cleaning heat exchanger bundles use high pressure water blasting or chemical cleaning. For example, a high pressure water cleaning method is described in U.S. Pat. No. 5,018,544. The method involves rotating the heat exchanger tube bundle while spraying the bundle with high pressure water. The water pressures typically needed to effectively clean the tube bundles using this method are in the range of about 10,000 psi at flow rates as high as 100 gallons per minute. An example of a chemical cleaning process is described in U.S. Pat. No. 5,437,296. The method involves soaking and spraying the exterior of a heat exchanger tube bundle with a chemical cleaning fluid solution consisting of DTE light oil and Mobilsola® flushing oil. The method also relies on high pressure water and abrasive plugs to clean the interior of the individual heat exchanger tubes.

These methods suffer a number of disadvantages. First, removal of the heat exchanger tube bundles from service typically requires a shut-down of the plant's operation. Current methods for cleaning heat exchanger tube bundles often require the bundle to be removed from service for three to five days. As a result, the cleaning of heat exchanger tube bundles can lead to significant revenue losses for the plant operator. In addition, current methods typically remove only about 80-85% of the hydrocarbon deposits from the heat exchanger tube bundles. Thus, the heat exchangers have a limited efficiency even after the cleaning process. The incomplete removal of deposits in the cleaning process also demands that the heat exchanger tube bundles be cleaned frequently.

Additionally, current methods of cleaning heat exchanger tube bundles leave a large environmental footprint. Current methods employ large quantities of water and/or chemical cleaning agent. During use, this water and/or chemical cleaning agent becomes contaminated with hazardous materials, creating large amounts of hazardous waste. Disposal of the waste creates potential environmental hazards and often requires special treatment, which increases the total costs of the cleaning process. Finally, current methods of cleaning heat exchanger tube bundles require large expenditures of energy and often produce significant amounts of greenhouse gases.

SUMMARY OF THE INVENTION

The present invention comprises a method and system of cleaning a heat exchanger tube bundle so as to remove hydrocarbon deposits. Using embodiments of the present invention, bundle cleaning time may be reduced by as much as 800 percent over current methods, making the process more cost-effective by drastically cutting down on the amount of time which the heat exchanger must be taken off-line. Further, using embodiments of the present invention, up to 98% of hydrocarbon deposits may be removed from a heat exchanger tube bundle, yielding a significant increase in the efficiency of the bundle when it is brought back on-line.

In an embodiment of the present invention, a heat exchanger tube bundle is cleaned of hydrocarbon deposits using an organic solvent. The bundle is placed into a reservoir filled to a desired level with organic solvent. During a cleaning cycle, the bundle is rotated and organic solvent is sprayed across the surfaces of the bundle. The cleaning cycle is continued for a period of time sufficient to obtain a desired degree of hydrocarbon removal, at which point the cycle is deactivated.

Another embodiment of the present invention comprises a system for the cleaning of a heat exchanger tube bundle. The system comprises a cleaning chamber configured to immerse a heat exchanger tube bundle within a reservoir of organic solvent. The system also comprises a plurality of sprayers connected to a supply of organic solvent and a rotating unit configured to rotate the bundle while it is sprayed with organic solvent. The system permits a significant amount of hydrocarbon deposits to be removed in a relatively short amount of time when compared with current systems.

The present invention also comprises a method and system for removing solids, base waters, and/or suspended hydrocarbons from an organic solvent. Thus, the present invention comprises a method and system for cleaning a heat exchanger tube bundle with an organic solvent that provides for the recovery and re-use of the organic solvent.

Using embodiments of the present invention, a heat exchanger tube bundle may be cleaned in a way that generates a minimal environmental impact. For example, after use in the heat exchanger tube bundle cleaning process, the organic solvent may be treated and then again used in the cleaning of a heat exchanger tube bundle, thereby preventing both the release of the solvent into the environment and the need for expensive disposal measures. By selecting an organic solvent that can be cost-effectively separated from suspended hydrocarbons, embodiments of the present invention also provide a more efficient method for the cleaning of a heat exchanger tube bundle. Further, using embodiments of the present invention, hydrocarbons that are separated from the organic solvent can be collected and/or treated to provide useful products. Thus, embodiments of the present invention both lower the environmental impact of the cleaning process and create a more cost-effective process.

In an embodiment of the present invention, hydrocarbon deposits are removed from a heat exchanger tube bundle by contacting the heat exchanger tube bundle with an organic solvent. The organic solvent is then treated to remove suspended hydrocarbons and again contacted with a heat exchanger tube bundle for the removal of hydrocarbon deposits.

In another embodiment of the present invention, hydrocarbon deposits are removed from a heat exchanger tube bundle by contacting the heat exchanger tube bundle with an organic solvent. The organic solvent is then treated, first to remove solids and/or base waters, and second to remove suspended hydrocarbons. The treated solvent is then again contacted with a heat exchanger tube bundle for the removal of hydrocarbon deposits.

In yet another embodiment of the present invention, hydrocarbon deposits are removed from a heat exchanger tube bundle by contacting the heat exchanger tube bundle with an organic solvent. The organic solvent is then treated and again contacted with a heat exchanger tube bundle for the removal of hydrocarbon deposits. Additionally, organic solvent that is vaporized during the cleaning of the heat exchanger tube bundle is collected from a gas mixture and again contacted with a heat exchanger tube bundle in the cleaning process.

In yet another embodiment of the present invention, hydrocarbon deposits are removed from a heat exchanger tube bundle by contacting the heat exchanger tube bundle with an organic solvent. The organic solvent is then treated to remove suspended hydrocarbons and again contacted with a heat exchanger tube bundle for the removal of hydrocarbon deposits. The hydrocarbons that are separated from the solvent are then collected, and sometimes treated, to produce a refinable oil.

Another embodiment of the present invention comprises a system for the cleaning of a heat exchanger tube bundle, wherein the system is configured to send contaminated organic solvent to a recovery unit that is configured to remove suspended hydrocarbons, and then to recirculate the treated organic solvent for contact with a heat exchanger tube bundle.

Another embodiment of the present invention comprises a system for the cleaning of a heat exchanger tube bundle, wherein the system is configured to send contaminated organic solvent to a recovery unit that is configured to remove solids and/or base waters and suspended hydrocarbons. The system is then configured to recirculate the treated organic solvent for contact with a heat exchanger tube bundle.

Yet another embodiment of the present invention comprises a system for the cleaning of a heat exchanger tube bundle, wherein the system is configured to treat contaminated organic solvent and recirculate the treated organic solvent for contact with a heat exchanger tube bundle. Additionally, the system is configured to collect a gas mixture, condense the vaporized organic solvent from the gas mixture, and recirculate the organic solvent for contact with a heat exchanger tube bundle.

Another embodiment of the present invention comprises a system for the cleaning of a heat exchanger tube bundle, wherein the system is configured to treat contaminated organic solvent to remove suspended hydrocarbons and recirculate the treated organic solvent for contact with a heat exchanger tube bundle. The system is also configured to collect the hydrocarbons that are separated from the contaminated organic solvent to produce a refinable hydrocarbon product.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1A:
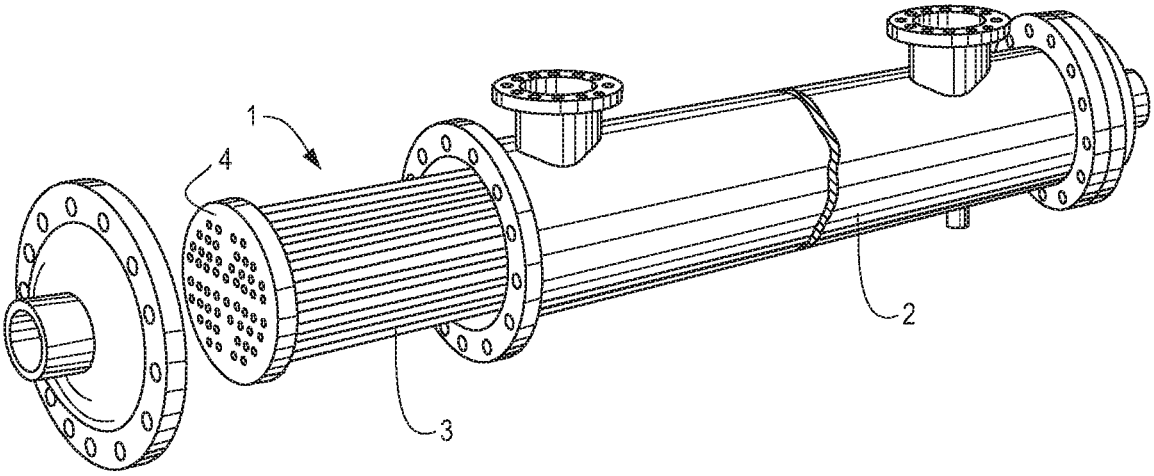
FIG. 1A is a perspective view of a heat exchanger tube bundle of the type that can be cleaned using the method and/or system of the present invention, including and being removed from its shell.
Figure 1B:
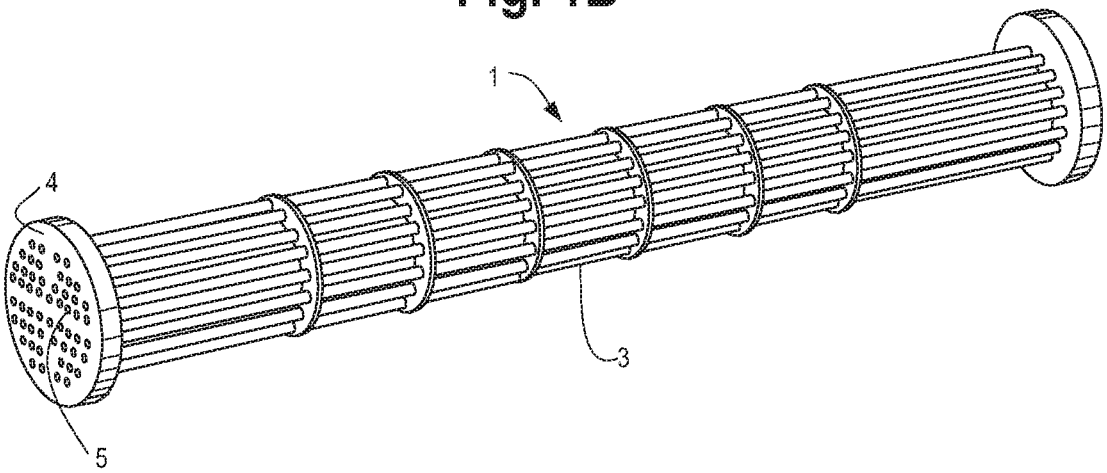
FIG. 1B is a perspective view of a heat exchanger tube bundle of the type that can be cleaned using the method and/or system of the present invention.

A heat exchanger tube bundle of the type that may be treated by the present invention is illustrated in FIG. 1. A heat exchanger tube bundle 1 is made up of a large number of individual tubes packed together to form a cylindrical structure. When in use, the heat exchanger tube bundle is surrounded by a shell 2. Accordingly, a heat exchanger tube bundle 1 comprises an exterior, or shell-side, surface 3 and a tube sheet surface 4. Heat exchanger bundles are often very large, typically ranging up to 84 inches in diameter and 30 feet in length. When used in certain industries, such as the gas and oil industry, heat exchanger tube bundles 1 become contaminated with hydrocarbon deposits, such as heavy oils, diluents, paraffins and/or bitumen.

Heat Exchanger Tube Bundle Cleaning System

Figure 2:
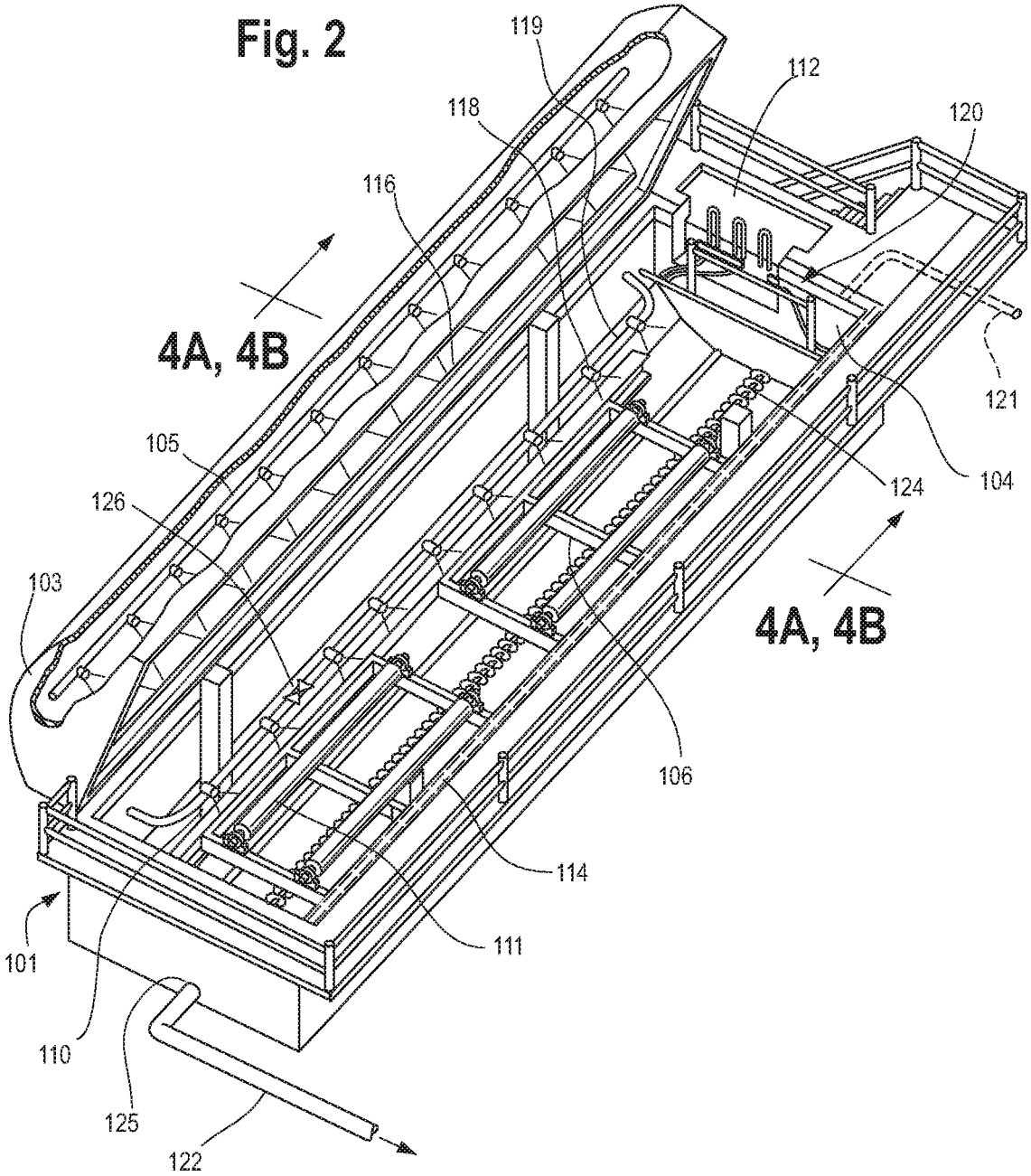
FIG. 2 is a perspective view, partly in section, of an embodiment of a cleaning chamber configured for the removal of hydrocarbon deposits from a heat exchanger tube bundle.

According to an aspect of the present invention, a system is provided for the removal of hydrocarbon deposits from a heat exchanger tube bundle by immersion in an organic solvent. A preferred embodiment of a system of the present invention is illustrated in FIG. 2.

In an embodiment of the present invention, the system comprises a cleaning chamber 101 into which a heat exchanger tube bundle 1 may be loaded and cleaned. The cleaning chamber comprises a four-sided tank, or base 102, with a hinged lid 103. The four sides of the tank surround a reservoir 104 configured for the immersion of a heat exchanger tube bundle 1 in an organic solvent. When the lid 103 is open, the reservoir 104 is configured to receive a heat exchanger tube bundle 1. The lid 103, when closed, preferably forms a tight seal with the four sides of the base 102, such that, during use, the cleaning chamber 101 can be evacuated of air and/or maintained under pressure. More preferably, the lid 103 is configured to form an air-tight seal with the base of the tank 102, such as through the compression of a rubber seal between the tank lid and the base of the tank.

The underside of the lid 103 preferably includes a rinsing manifold 105 configured for the spraying of organic solvent along the length of a heat exchanger tube bundle 1. Preferably, the rinsing manifold 105 spans the entire length of the reservoir 104. The rinsing manifold 105 is also preferably mounted in or about the center of the lid 103, such that the spray of organic solvent will be directly over the top of a heat exchanger tube bundle 1.

The system also preferably includes a cradle 106, or support structure, which is configured to support a heat exchanger tube bundle 1 in the reservoir 104. In a preferred embodiment, the cradle 106 may be adjusted to support heat exchanger tube bundles 1 of different sizes. Preferably, the cradle 106 is configured to support heat exchanger tube bundles 1 having diameters up to 84 inches and lengths up to 30 feet.

Figure 3:
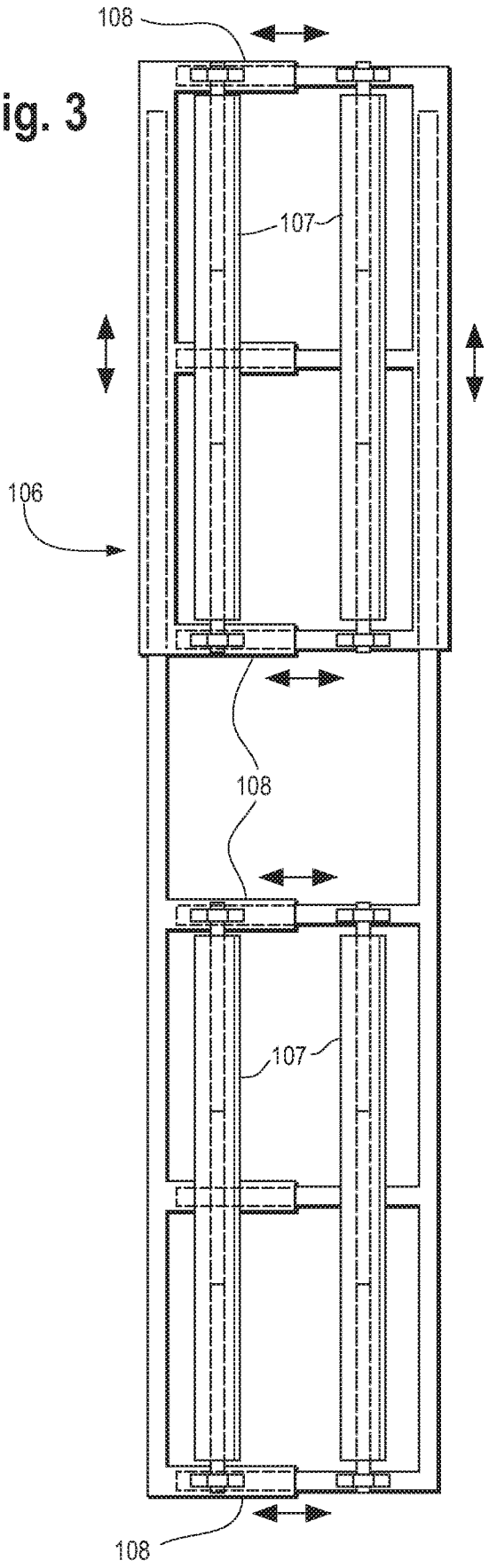
FIG. 3 is top plan view, partly in section, of an embodiment of a cradle configured for use with heat exchanger tube bundles of varying dimensions.

An example of a cradle 106 according to a preferred embodiment of the present invention is illustrated in FIG. 3. In this preferred embodiment, select members of the cradle 107, 108 are telescoping. Accordingly, by adjusting certain telescoping members 107 along the length of the cradle, the cradle 106 may be configured to accommodate a heat exchanger tube bundle 1 having a particular length. Similarly, by adjusting certain telescoping members 108 spanning the width of the cradle, the cradle 106 may be configured to accommodate a heat exchanger tube bundle 1 having a particular diameter. The telescoping members 107, 108 are preferably actuated hydraulically.

Figure 4A:
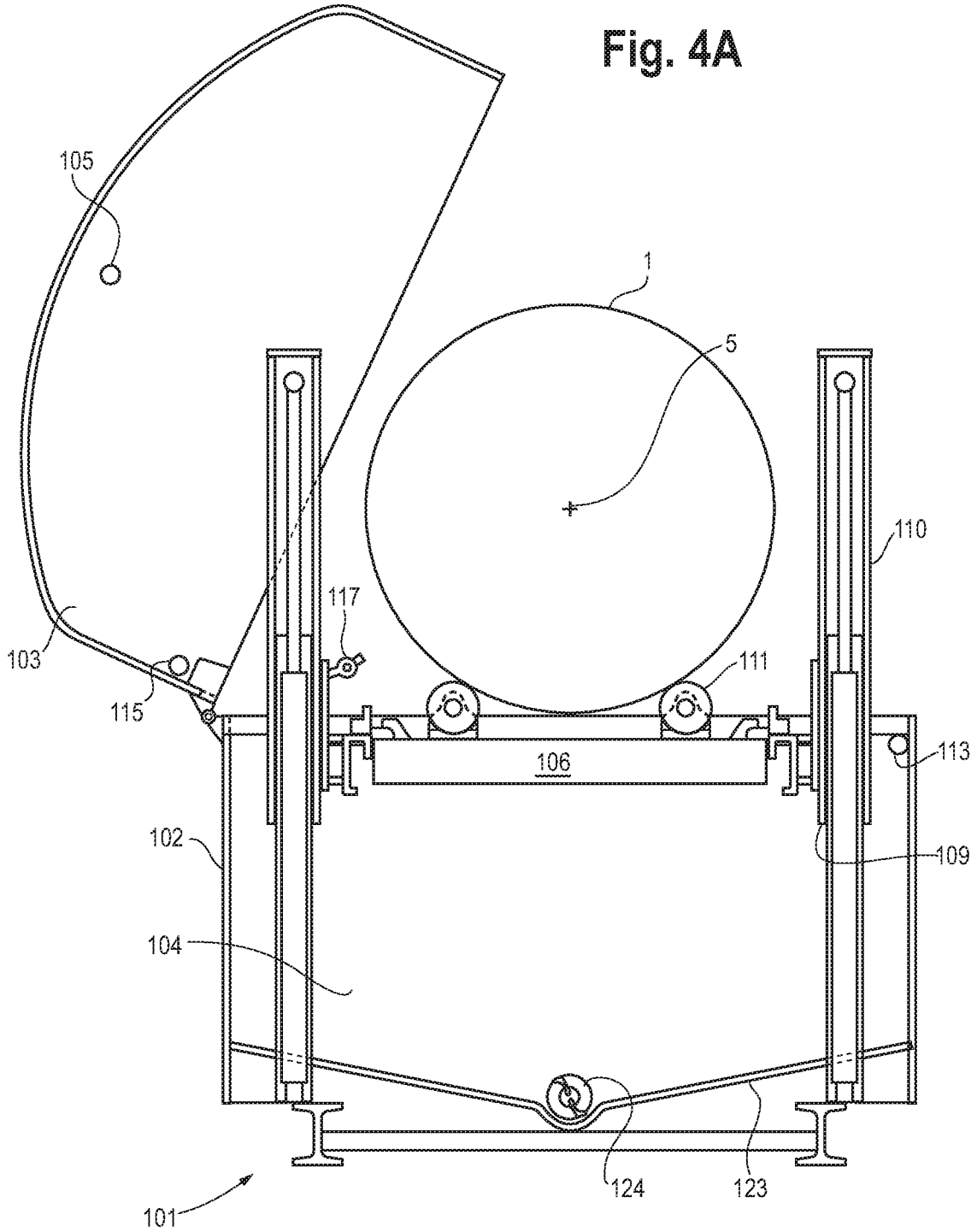
FIG. 4A is a rear elevation view, in section, of an embodiment of a cleaning chamber having a heat exchanger tube bundle loaded onto an elevated cradle.
Figure 4B:
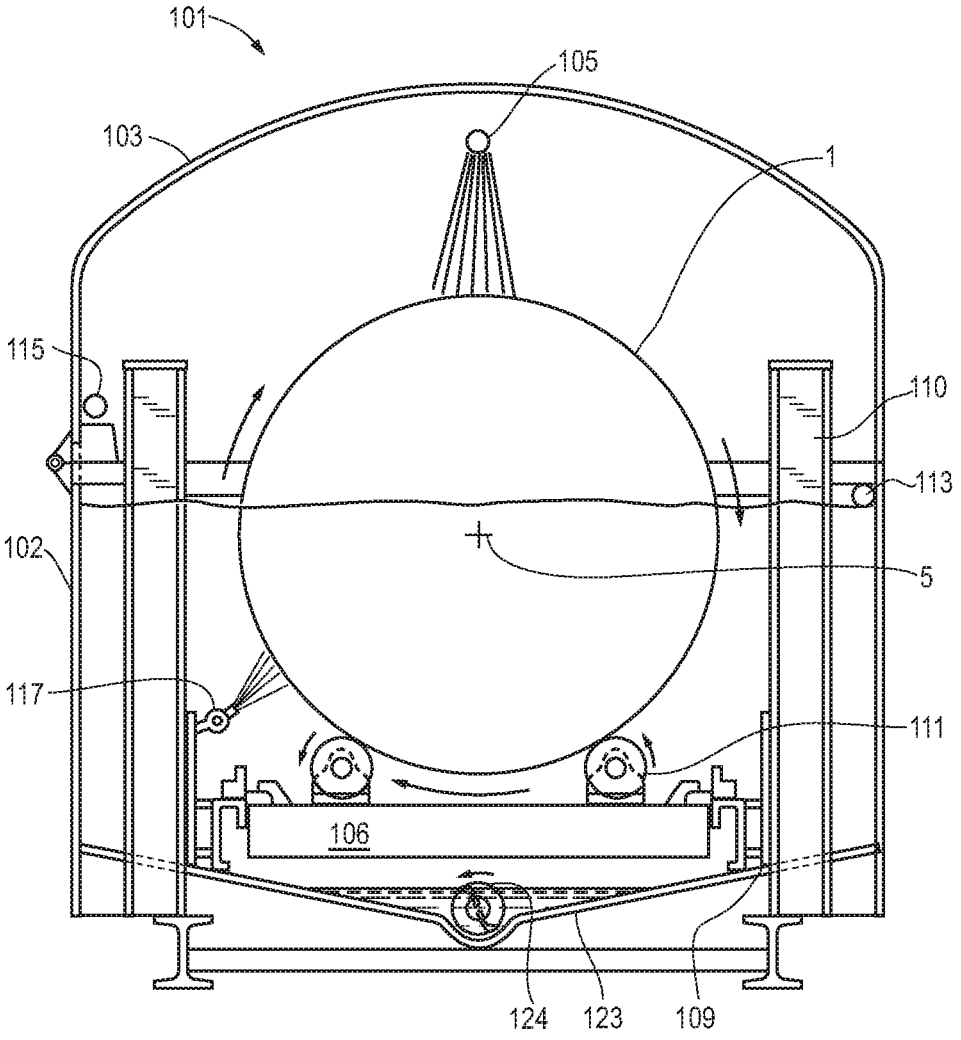
FIG. 4B is a rear elevation view, in section, of an embodiment of a cleaning chamber having a heat exchanger tube bundle contained in a reservoir that is filled with an organic solvent.

The system also preferably includes a lifting system 109, or elevator, that is operably connected to the cradle 106 such that the cradle can be raised out of and lowered into the reservoir 104. An example of lifting system according to an embodiment of the present invention is illustrated in FIGS. 4A and 4B. In a further preferred embodiment, the lifting system 109 comprises four hydraulic cylinders 110. Preferably, the two hydraulic cylinders 110 at one end of the cleaning chamber 101 operate independently from the two hydraulic cylinders at the other end of the cleaning chamber. This design allows the lifting system 109 to be operated to tilt the heat exchanger tube bundle 1 at a small incline, thereby allowing organic solvent to drain from the individual tubes of the bundle.

The system further preferably comprises rollers 111, which are configured to rotate a heat exchanger tube bundle 1 around the axis running through the center of the tube sheet 5. Preferably, the rollers 111 may be located so as to be operable with heat exchanger tube bundles of different sizes, such as through the use of telescoping members. An example of rollers according to a preferred embodiment of the present invention is illustrated in FIG. 3. In this preferred embodiment, the rollers 111 are located on the cradle 106 and operably connected to the cradle such that an adjustment of the telescoping members of the cradle 107, 108 to accommodate a particular heat exchanger tube bundle 1 also serves to locate the rollers in a desired position. The rollers are preferably driven in series with independent hydraulic motors.

The system also preferably comprises a heating element 112 that is configured to raise or lower the temperature of the organic solvent to a desired operating temperature. In a preferred embodiment of the system, such as that illustrated in FIG. 2, the heating element 112 comprises one or more heat exchangers contained within the base of the tank 102, through which the organic solvent may be circulated. Additionally, the cleaning chamber 101 is preferably insulated to help maintain the organic solvent in the reservoir 104 at the desired operating temperature.

Preferably, the system also comprises one or more gas inlets 113 that are configured to provide a controlled flow of a process gas into the cleaning chamber 101 during the cleaning of the heat exchanger tube bundle 1. The gas inlets 113 are preferably configured to carry the process gas evenly across the surface of the organic solvent in the reservoir 104 when the reservoir is filled. In a preferred embodiment, such as that illustrated in FIG. 2, the one or more gas inlets 113 comprise a manifold 114 that runs along the full length of the reservoir 104. The manifold 114 may be located either on the base 102, as in FIG. 2, or on the interior of the lid 103.

The system also preferably comprises one or more gas outlets 115 that are configured to remove vapors from the cleaning chamber 101 during the cleaning of a heat exchanger tube bundle 1. Preferably, the gas outlets 115 run along the full length of the reservoir 104 to ensure the extraction of vapors across the entire surface of the organic solvent in the reservoir. In a preferred embodiment, the one or more gas outlets 115 comprise a ventilation duct 116 running along the underside of the lid 103, such as in FIG. 2, or along the base 102. To ensure that the process gas flows across the entire surface of the organic solvent in the reservoir 104, the one or more gas outlets 115 should be located on the opposite side of the reservoir from the one or more gas inlets 113. The one or more gas outlets 115 also preferably include pressurized valves, which allow a positive pressure to be maintained within the cleaning chamber 101.

The system further comprises a shell-side spraying system 117 that is configured to spray a pressurized stream of organic solvent against the shell-side surface 3 of the heat exchanger tube bundle 1. In a preferred embodiment, such as that illustrated in FIG. 2, the shell-side spraying system 117 preferably comprises a plurality of nozzles 118 configured to spray the entire shell-side surface 3 of a heat exchanger tube bundle 1, such as via connection to one or more manifolds 119 running the length of the reservoir 104. The spraying system 117 is preferably located below the surface level of the organic solvent in the reservoir 104, when filled, in order that they may aggressively circulate the organic solvent in the reservoir against the outer surfaces of the heat exchanger tube bundle. Preferably, the shell-side spraying system 117 is also operably connected with the lifting system 109, for example so that the hydraulic cylinders 110 do not interrupt the spray of organic solvent from the spraying system.

In a preferred embodiment of the spraying system 117, the one or more manifolds 119 may also include an isolation valve 126. The isolation valve 126 is operable to either allow or shut down the flow of organic solvent to a selected portion of the manifold 119. The isolation valve 126 is preferably located at or about twenty-two feet along the length of the manifold 119, or at another such location that corresponds to a common length of heat exchanger tube bundles 1. For example, using this embodiment, when the system is used to clean a heat exchanger tube bundle 1 having a length of twenty-two feet or less, the isolation valve 126 is closed, thereby blocking the flow of organic solvent to the portion of the manifold 119 that extends past the end of the heat exchanger tube bundle and concentrating the spray of organic solvent only along the length of the heat exchanger tube bundle. However, when this embodiment of the system is used to clean a heat exchanger tube bundle 1 having a length greater than twenty-two feet, the isolation valve 126 is opened, allowing the flow of organic solvent along the entire length of the manifold 119.

Figure 5A:
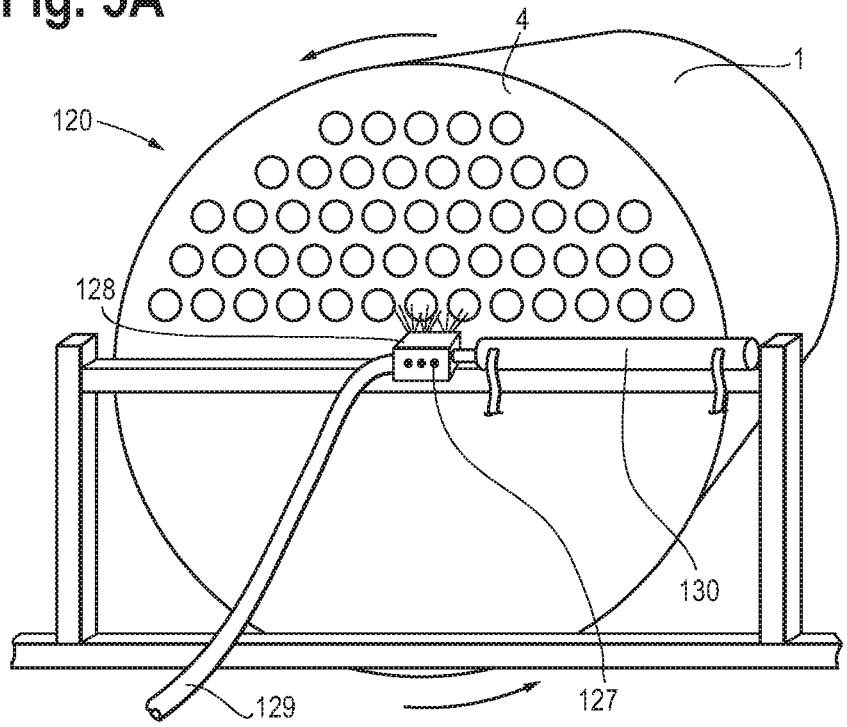
FIG. 5A is a perspective view of an embodiment of a tube sheet spraying system, configured to spray organic solvent into tubes at a first set of diameters of the tube sheet as the heat exchanger tube bundle rotates.
Figure 5B:
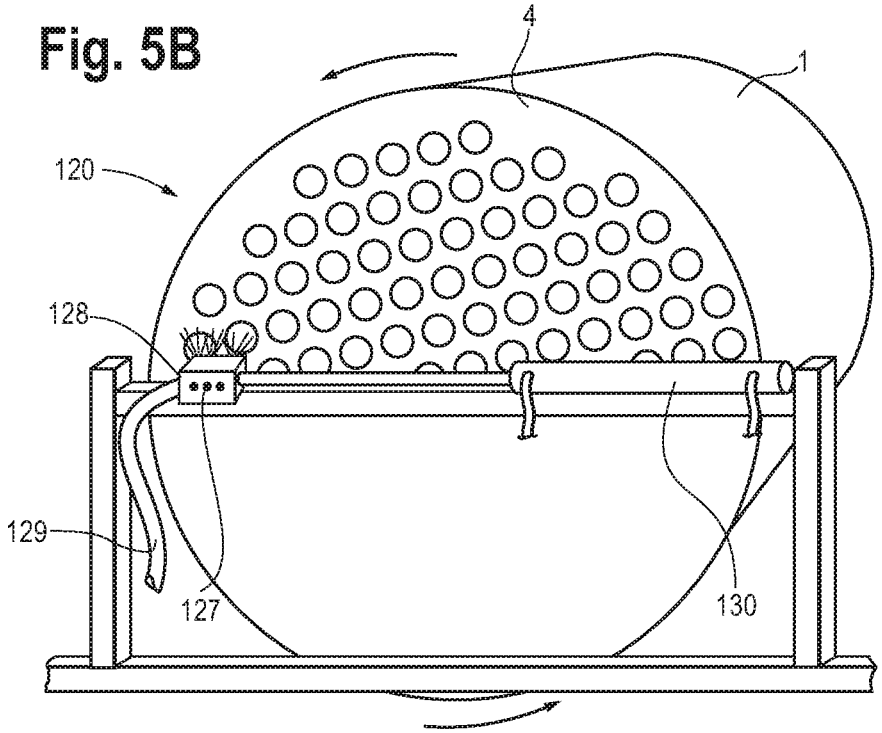
FIG. 5B is a perspective view of an embodiment of a tube sheet spraying system, configured to spray organic solvent into tubes at a second set of diameters of the tube sheet as the heat exchanger tube bundle rotates.

The system also preferably comprises a tube-sheet spraying system 120 configured to spray a pressurized stream of organic solvent into the individual tubes that make up the heat exchanger tube bundle 1. A tube-sheet spraying system 120 according to a preferred embodiment is illustrated in FIGS. 5A and 5B. In this embodiment, the tube-sheet spraying system 120 comprises one or more high-pressure nozzles 127 that are configured to travel laterally across the tube sheet 4 of a heat exchanger tube bundle 1. Accordingly, the one or more nozzles 127 are configured to spray organic solvent into all of the individual tubes at a first set of diameters of the tube sheet 4 as the heat exchanger tube bundle 1 rotates. See, for example, FIG. 5A. Then, after the one or more nozzles have traveled a particular distance laterally across the tube sheet 4, the one or more nozzles are configured to spray organic solvent into all of the individual tubes at different sets of diameters of the tube sheet 4 as the heat exchanger tube bundle 1 rotates. See, for example, FIG. 5B. The lateral movement of the one or more nozzles 127 may be controlled hydraulically, such as through a hydraulic ram 130. Preferably, the tube sheet spraying system 120 comprises multiple nozzles 127 located on a manifold 128, and having a single input of organic solvent 129.

The system also comprises one or more fluid inlets 121 configured to convey organic solvent into the cleaning chamber 101. It also comprises one or more fluid outlets 122 through which contaminated organic solvent can be evacuated from the reservoir 104. In a preferred embodiment, such as that illustrated in FIG. 4, the floor 123 of the reservoir is sloped downward from the side walls of the base 102 to the center of the reservoir 104. An auger system 124 runs across the bottom of this sloped floor 123. The auger system 124 is configured to transport solids to a drainage point from which they can be removed from the reservoir 104. The drainage point preferably comprises a pipe 125, such as a suction pipe, that is capable of ensuring that solids are effectively removed from the reservoir 104. The drainage point may also be operably connected to one of the one or more fluid outlets 122 through which contaminated organic solvent is evacuated from the reservoir 104.

The system also comprises one or more pumps 131, 132, which are configured to fill and empty the reservoir 104, and to circulate the organic solvent to all of the shell-side spraying system 117, the tube sheet spraying system 120, and the rinsing manifold 105. In the embodiment illustrated in FIG. 6, a first pump 131 is configured to control the flow of organic solvent into the cleaning chamber 101 and through the various spraying systems and rinsing manifolds and a second pump 132 is configured to control the flow of contaminated organic solvent and solids out of the cleaning chamber 101. Alternatively, for example, a single pump could be used to control all of the organic solvent flows into and out of the cleaning chamber 101. In another embodiment, the second pump 132 may also be configured to pump contaminated organic solvent into one or both of the spraying systems 117, 120. In that way, the second pump 132 could be used to supplement the flow of organic solvent to the spraying systems 117, 120 where particularly high flow rates of organic solvent are desired.

Organic Solvent Recovery System

Another embodiment of the present invention comprises a system for treatment of the organic solvent used in the cleaning of a heat exchanger tube bundle, also known as contaminated organic solvent. The organic solvent recovery system is not limited to use in connection with any particular system for the removal of hydrocarbon deposits from a heat exchanger tube bundle. However, for purposes of illustration, the organic solvent recovery system is described as being configured to operate in connection with the cleaning chamber 101 described above. In this preferred embodiment, the one or more fluid outlets 122 of the cleaning chamber 101 are operably connected, such as via piping, to the inlet 202 of a recovery unit 201. One or more outlets of the recovery unit 218, 225 are operably connected to a fluid inlet 121 of the cleaning chamber.

Figure 7:
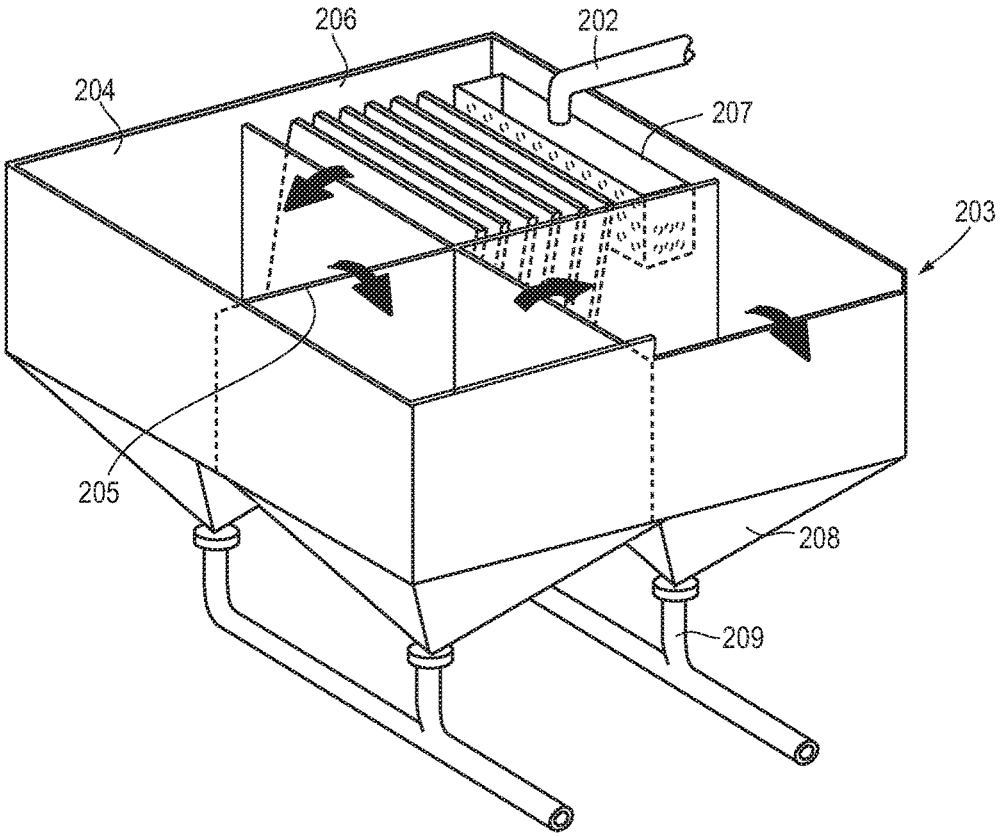
FIG. 7 is a perspective view of an embodiment of a separation unit, configured for the separation of solids and base waters from organic solvent, such as that used in the cleaning of a heat exchanger tube bundle.

In an embodiment of the present invention, the organic solvent recovery system comprises a separation unit 203 configured to separate the organic solvent from solids and/or base waters. A preferred embodiment of a separation unit 203 is illustrated in FIG. 7. In this embodiment, the separation unit 203 comprises a plurality of separation tanks 204 connected in series. Each of the separation tanks 204 is separated from the next via a weir 205, which is configured so that an organic solvent having a lower content of solids and/or base waters flows from one separation tank into the next. Each weir 205 also ensures that a constant level of organic solvent is maintained in each separation tank 204. The embodiment illustrated in FIG. 7 comprises four separation tanks 204; however, any number of separation tanks may be connected in series, depending on the difficulty of separating the organic solvent from solids and/or base waters.

Additionally, one or more of the plurality of separation tanks 204 preferably comprise a series of knock-out plates 206, each of which is configured to allow organic solvent having a lower content of solids and/or base waters to pass over the top of the plate and move downstream. Preferably, each of the knock-out plates 206 is set at a slight grade, such as about ten degrees, with the top being slightly further upstream than the bottom. This grade forces the solids and/or base waters to fall out in a downstream direction, increasing the effectiveness of the separation. Preferably, the knock-out plates 206 are evenly spaced apart to maximize the efficiency of the process. In the preferred embodiment illustrated in FIG. 7, only the first, or most upstream, of the separation tanks 204 contains knock-out plates 206. However, any number of the separation tanks may contain knock-out plates. Preferably, the first separation tank 204, i.e. the separation tank into which the contaminated organic solvent initially flows, also contains a diffuser 207. The diffuser 207 is configured to break the column of fluid entering the tank 204 and provide for a more controlled diffusion of the fluid into the tank.

Preferably, one or more of the plurality of separation tanks 204 has a cone-shaped bottom 208 configured to funnel the solids and/or base waters to an outlet point from which they may easily be removed. The outlet point of each cone 208 may be connected to piping 209, such as suction pipes, through which the solids and/or base waters that sink to the bottom of the cone 208 can be removed. Preferably, the piping 209 from each of the separation tanks is interconnected, such that the solids and/or base waters are all sent to the same place for further treatment or disposal.

Figure 8:
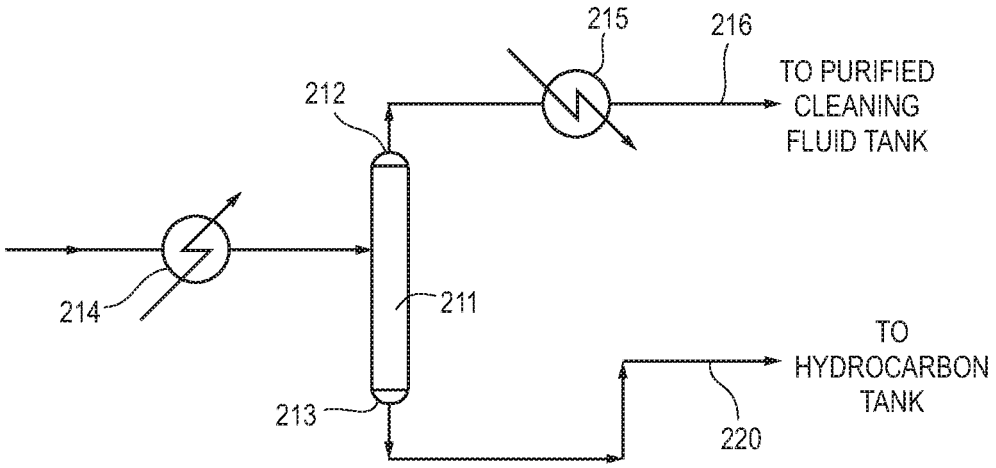
FIG. 8 is a flow diagram of an embodiment of a distillation unit, configured for the separation of suspended hydrocarbons from organic solvent, such as that used in the cleaning of a heat exchanger tube bundle.

In an embodiment of the present invention, the solvent recovery system comprises a distillation unit 210. The distillation unit 210 is configured to separate the organic solvent from the hydrocarbons suspended therein. A preferred embodiment of the distillation unit is illustrated in FIG. 8. The distillation unit 210 preferably comprises a continuous distillation column 211. The distillation column 211 has a tops outlet 212, from which the purified organic solvent fraction is withdrawn, and a bottoms outlet 213, from which the hydrocarbons fraction is withdrawn. Preferably, the distillation unit 210 also comprises a preheater 214, which increases the efficiency of the distillation process. The distillation unit 210 also comprises a condenser 215, which is configured to receive the purified organic solvent fraction exiting the top of the distillation column 211 and condense it to a liquid form.

The outlet of the distillation unit through which the purified organic solvent flows is preferably connected, such as via piping 216, to a purified organic solvent tank 217. The purified organic solvent tank 217 is operably connected to the cleaning chamber 101, such as via outlet 218, so that the purified organic solvent can be supplied to a fluid inlet 121 of the cleaning chamber. Alternatively, though not shown in FIG. 6, the purified organic solvent exiting the distillation unit 210 may be directly connected to an inlet 121 of the cleaning chamber 101 so that the purified organic solvent can be conveyed directly to the cleaning chamber.

A preferred embodiment of the organic solvent recovery system of the present invention also comprises an enhanced oil recovery tank 219. The enhanced oil recovery tank 219 is operably connected to the bottoms outlet 213 of the distillation column 211, such as by piping 220, to receive the hydrocarbon bottoms from the distillation. The enhanced oil recovery tank 219 is preferably configured to separate the hydrocarbon fraction of the distillation process into the lighter hydrocarbon oils and the heavier hydrocarbons, such as by settling. Preferably, the enhanced oil recovery tank 219 has either a conical bottom or a sloped bottom, with the lowest point being connected to a suction pipe configured so that the heavier hydrocarbons can easily be collected for disposal. Preferably, the enhanced oil recovery tank 219 also comprises a system, such as a skimmer and/or a weir, by which the lighter hydrocarbon oils may be collected.

In another preferred embodiment, the organic solvent recovery system also comprises a storage tank 223. The storage tank 223 is connected, such as via piping 224, to the inlet of the distillation unit 210. The storage tank 223 is also connected, such as via outlet 225, to an inlet 121 of the cleaning chamber 101. Accordingly, the storage tank 223 is configured so that an operator can convey organic solvent to either the distillation unit 210 or the cleaning chamber 101, depending on which valve is opened. In a preferred embodiment, the storage tank 223 is operably connected to the separation unit 203, such that the organic solvent exits the separation unit and flows into the storage tank. In a preferred embodiment, the organic solvent flows over the top of a weir 205 that separates the final separation tank 204 of the series and the storage tank 223.

Preferably, the recovery system comprises at least a distillation unit 210. More preferably, the recovery system comprises at least a separation unit 203 and a distillation unit 210. More preferably, the recovery system comprises at least a separation unit 203, a distillation unit 210, and a storage tank 223.

Vapor Recovery System

Another embodiment of the present invention comprises a vapor recovery system configured to recover organic solvent lost to vaporization during the cleaning of a heat exchanger tube bundle. The vapor recovery system is not limited to use in connection with any particular system for the removal of hydrocarbon deposits from a heat exchanger tube bundle. However, for purposes of illustration, the vapor recovery system is described as being configured to operate in connection with the cleaning chamber 101 described above.

Because of the high temperatures at which the cleaning process may be performed, significant quantities of organic solvent may evaporate and mix with the process gas in the cleaning chamber 101 to form a gas mixture. The vapor recovery system is configured to condense the organic solvent out of the gas mixture and return the liquid organic solvent to the cleaning chamber 101. When used in connection with an organic solvent recovery system, such as that described above, the vapor recovery system increases the total amount of organic solvent that can be recovered and reused in a heat exchanger tube bundle cleaning system, yielding both improved efficiency and a more environmentally-friendly system.

Figure 9:
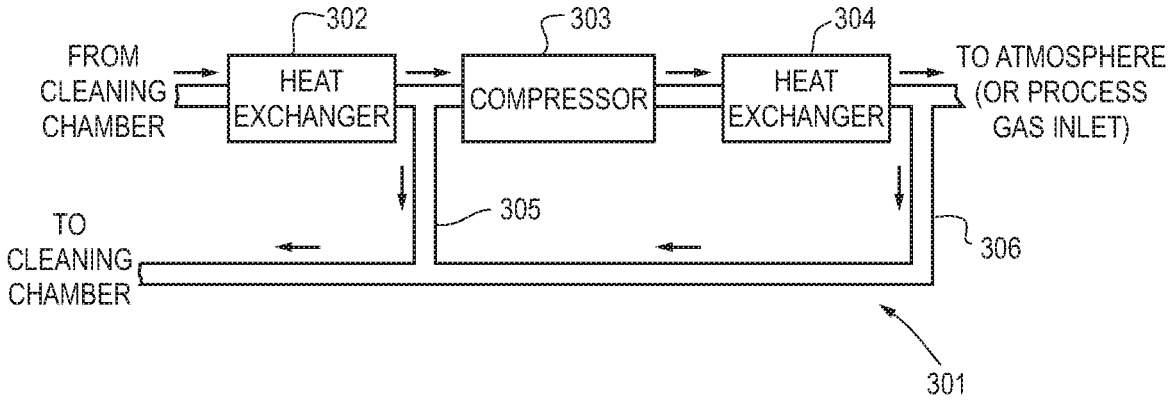
FIG. 9 is a flow diagram of an embodiment of a vapor recovery unit, configured for the separation of organic solvent from a gas mixture comprising a process gas and vaporized organic solvent.

When used in connection with the cleaning chamber 101 described above, the one or more gas outlets 115 of the cleaning chamber are connected to an input of the vapor recovery system. The vapor recovery system preferably comprises at least one heat exchanger and one compressor. A preferred embodiment of the vapor recovery system 301 is illustrated in FIG. 9. In this embodiment, the system comprises, in series, a first heat exchanger 302, configured to lower the temperature of the gas mixture, a compressor 303, configured to raise the pressure of the gas mixture, and a second heat exchanger 304, configured to lower the temperature of the compressed gas mixture. The first and second heat exchangers 302, 304 are each operably connected with an outlet for the removal of condensed organic solvent from the gas mixture. The first and second heat exchangers 302, 304 may also be combined in a single unit having two bundles and one cooling stream. For instance, in the case of an air-cooled heat exchanger, the heat exchanger may have two bundles and one air fan. The compressor 303 is preferably a small, single-stage compressor.

In an alternative embodiment, the vapor recovery system comprises a compressor with a refrigeration system that is configured to condense the organic solvent at an elevated pressure and a very low temperature. This embodiment is capable of achieving close to 100% recovery of the organic solvent from the gas mixture; however, it would require additional expenses over the preferred embodiment described above. Other embodiments of the vapor recovery system, such as those comprising a free-spindle turbo-expander or a Pressure Swing Adsorption system (PSA) may also be used in order to recover close to 100% of the organic solvent, but at an increased expense over the preferred embodiment shown in FIG. 9.

Heat Exchanger Tube Bundle Cleaning Process

In another embodiment of the present invention, a heat exchanger tube bundle 1 is cleaned of hydrocarbon deposits using an organic solvent.

In this embodiment, a heat exchanger tube bundle 1 is loaded into the reservoir 104 of a cleaning chamber 101, such as that illustrated in FIG. 2. For example, to load the bundle 1 into a preferred embodiment of the cleaning chamber 101, it is first moved to a location above the cleaning chamber. This step may comprise the use of rail, crane, picker unit, or any other device capable of a controlled locating of a heat exchanger tube bundle 1. The bundle 1 is then placed onto a supporting structure, or cradle 106. Preferably, the cradle 106 is operably connected to the cleaning chamber 101 so that it can be raised from the reservoir 104 of the cleaning chamber for simplified loading of the bundle 1. For example, FIG. 4A illustrates a heat exchanger bundle 1 being loaded onto a raised cradle 106 in accordance with a preferred embodiment of this process. The cradle 106, now supporting the heat exchanger bundle 1, is then lowered into the reservoir 104 of the cleaning chamber 101. See, for example, FIG. 4B.

In a preferred process of loading a heat exchanger tube bundle 1 into the reservoir 104 of a cleaning chamber 101, the dimensions of the cradle 106 may be adjusted, such as by telescoping members 107, 108, to accommodate the dimensions of the particular heat exchanger tube bundle being loaded. FIG. 3 illustrates an example of a cradle that can be used according to this preferred process. In this way, the supporting structure of the cradle 106 is configured to provide maximum support for a bundle 1 of particular dimensions before the bundle is loaded onto the cradle. Optionally, and if the dimensions of the heat exchanger tube bundle 1 permit, a basket containing smaller related components may also be placed into a docking portion of the cradle 106 for cleaning.

Once the heat exchanger tube bundle 1 is loaded in the reservoir 104 of the cleaning chamber 101, the cleaning chamber is sealed. Accordingly, the lid 103 is lowered into position, preferably forming a tight seal with the base of the cleaning chamber 102. See, for example, FIG. 4B.

The reservoir 104 is filled with organic solvent to a desired level, preferably such that greater than fifty percent of the heat exchanger bundle 1 is submerged in the organic solvent. In other words, the reservoir 104 is preferably filled with organic solvent to a level that is higher than the center of the tube sheet 5 of the heat exchanger tube bundle 1. See, for example, FIG. 4B. The reservoir 104 may be filled with organic solvent prior to, during, and/or after the loading of the heat exchanger tube bundle 1 into the cleaning chamber 101.

The organic solvent is preferably brought to an operating temperature. The operating temperature is selected based on the properties of the particular organic solvent being used and the type and degree of hydrocarbon contamination on the heat exchanger tube bundle 1. The selection of both the particular organic solvent to be used and the operating temperature will depend largely on the profile of hydrocarbon deposits which are to be removed, with higher temperatures typically being required to soften the heavier hydrocarbon deposits. Higher temperatures may also be desirable if the amount of contamination is particularly high. Typically, the operating temperature is between about 35° and 90° C. More preferably, the operating temperature is between about 35° and 60° C. The organic solvent may be brought to its operating temperature, for example, through the use of a heat exchanger 112.

At some operating temperatures, it may be desirable to pump an inert gas into the cleaning chamber 101, so as to evacuate the cleaning chamber of air. For instance, the softening point of some of the heavier hydrocarbon deposits may require cleaning to be performed at an operating temperature at or above about 60° C. Such temperatures, however, are above the flash point of some of the preferred organic solvents. Thus, when using these preferred organic solvents, it may be necessary to keep the inside of the cleaning chamber 101 under an inert atmosphere. Alternatively, a preferred organic solvent having a higher flash point may be selected for use in the heat exchanger bundle cleaning process. It may also be desirable to maintain the inside of cleaning chamber 101 under an inert gas atmosphere during cleaning in order to simplify the recovery of any vaporised organic solvent, such as through the vapor recovery process described herein.

Once the heat exchanger tube bundle 1 is positioned in the reservoir 104 and the reservoir is filled to the desired level of organic solvent, operation of the cleaning cycle is begun. During the cleaning cycle, the heat exchanger tube bundle 1 is rotated. Preferably, rotation of the bundle 1 occurs at a rate of about 1 to 7 rpm. The bundle may be rotated, for example, by rollers 111, as illustrated in FIG. 4B. While the bundle 1 is rotated, organic solvent is sprayed across at least the shell-side surface 3 of the bundle. This spraying occurs across the entire length of the bundle 1 and utilizes high volumes of organic solvent and high pressure spraying. For example, a flow rate of greater than 3000 liters of organic solvent per minute may be sprayed along the length of the bundle. High pressure spraying helps to loosen and remove hydrocarbon deposits from the heat exchanger tube bundle 1. Preferably, the shell-side spraying occurs below the surface of the organic solvent in the reservoir 104. See, for example, FIG. 4B. This serves both to aggressively circulate the organic solvent in the reservoir 104 and to minimize losses of organic solvent due to vaporization. The spraying may be performed, for example, by a shell-side spraying system 117, such as one comprising a manifold 119 containing a number of high-pressure nozzles 118. See, for example, FIG. 2.

If the interior surfaces of the individual tubes that make up the heat exchanger tube bundle 1 require cleaning, organic solvent may also be sprayed across the tube sheet 4 of the bundle. This spraying may be performed either concurrent with the spraying of the shell-side surfaces 3 of the bundle or in a separate, additional step. The spraying of the tube sheet 4 causes a pressurized injection of the organic solvent into the interior of each tube of the bundle 1.

In a preferred embodiment, illustrated in FIG. 5, the tube sheet 4 spraying is performed by a system 120 comprising one or more nozzles 127 that travel laterally across the tube sheet. Thus, as the bundle 1 rotates, the one or more nozzles 127 forces organic solvent into the interior of each tube at a first set of diameters of the tube sheet 4. See, for example, FIG. 5A. After a predetermined amount of time, the one or more nozzles 127 move a small distance laterally across the tube sheet 4, such that the one or more nozzles forces organic solvent into the interior of each tube at a different set of diameters of the tube sheet 4 as the bundle 1 rotates. See, for example, FIG. 5B. This process may be repeated as many times as is necessary to treat all of the tubes of the heat exchanger tube bundle 1.

Preferably, the spraying system 120 is configured to spray organic solvent into the interior of the tubes just prior to the tubes being submerged into the organic solvent in the reservoir 104. It is also preferable that, during the spraying, the bundle 1 is maintained at a slight angle toward the spraying system 120 so that, as the bundle rotates, the tubes exit the submerged environment of the reservoir 104, and are able to drain before again being forcibly filled with organic solvent by the spraying system. Preferably, the tube sheet spraying is performed by a manifold 128 having multiple nozzles 127 such that the tubes at more than one set of diameters of the tube sheet 4 may be treated simultaneously. By using multiple nozzles 127, the process described above may be repeated a smaller number of times, cutting down on the length of the overall cleaning process.

During the cleaning cycle, the level of organic solvent in the reservoir 104 is preferably kept near constant. Accordingly, contaminated organic solvent is continuously removed from the reservoir 104 as new organic solvent is being added to the reservoir by the spraying process(es). Depending on the profile of hydrocarbon deposits on the heat exchanger tube bundle 1, not all of the hydrocarbon contaminants may be entirely soluble with the organic solvent. In those instances, any solid hydrocarbon contaminants may also be continuously removed from the reservoir 104 along with the contaminated organic solvent. This process may be expedited, for example, by the use of an auger system 124 running along the length of the floor 123 of the reservoir 104, which collects and transports the solids to an outlet. In a preferred embodiment of the cleaning process, the contaminated organic solvent and any solids exiting the cleaning chamber 101 are conveyed to an organic solvent recovery process, where the organic solvent is treated.

During the cleaning cycle, a near-constant pressure is also preferably maintained inside the cleaning chamber 101. This can be achieved by maintaining a controlled flow of a process gas both into and out of the cleaning chamber 101. The process gas is selected from the group preferably consisting of inert gases and air. During the cleaning cycle, an amount of organic solvent will evaporate or vaporize. By maintaining a controlled flow of process gas through the cleaning chamber 101, the vaporized organic solvent becomes mixed with the process gas and is continuously carried out of the cleaning chamber. Upon exiting the cleaning chamber 101, this gas mixture may either be vented directly to the atmosphere, or more preferably, sent to a vapor recovery process where the vaporized organic solvent is separated from the process gas and collected for re-use in the heat exchanger bundle cleaning process. The controlled flow of gas can be created, for example, using a series of gas inlets 113 and gas outlets 115 located on opposite ends of the cleaning chamber 101. See, for example, FIG. 4B.

The cleaning cycle is preferably run until all of the surfaces of the heat exchanger tube bundle 1 are substantially cleaned of hydrocarbon deposits. Preferably, greater than 90% of the hydrocarbon deposits are removed from the heat exchanger tube bundle 1. More preferably, greater than 95% of hydrocarbon deposits are removed from the heat exchanger tube bundle 1. Even more preferably, greater than 98% of hydrocarbon deposits are removed from the heat exchanger tube bundle 1. Once the removal of hydrocarbon deposits is deemed to be substantially complete, the cleaning cycle is shut down.

After the cleaning cycle, the heat exchanger tube bundle 1 may be rinsed. For example, the contaminated organic solvent may be transferred out of the reservoir 104 and then the bundle 1 may be rotated while organic solvent is sprayed across the shell-side surface 3 of the bundle. The rinsing spray is preferably located directly above the heat exchanger tube bundle 1, as illustrated in FIG. 4B. Also following the cleaning cycle, the individual tubes of the heat exchanger tube bundle 1 may be drained. For instance, one end of the bundle 1 may be raised to create a slope by which organic solvent will drain from the interior of the tubes that make up the heat exchanger tube bundle. This may be performed, by example, through a controlled raising of one end of the cradle 106, on which the bundle rests. To ensure complete draining of the organic solvent, the bundle 1 is preferably brought to a slope of at least six degrees.

After the cleaning cycle and, if performed, the draining and/or rinsing steps, the heat exchanger tube bundle 1 is removed from the cleaning chamber 101. To prevent the dripping of organic solvent outside of the cleaning chamber 101, it may be desirable to allow the bundle to dry before it is removed.

Organic Solvent Recovery Process

In an embodiment of the present invention, the organic solvent used in a heat exchanger tube bundle cleaning process is treated in an organic solvent recovery process and the treated organic solvent is then reused in the bundle cleaning process. In some embodiments, the contaminated organic solvent from a bundle cleaning process is continuously treated and recycled back to the bundle cleaning process, forming a closed loop system. The organic solvent recovery process may be performed on contaminated organic solvent used in any heat exchanger tube bundle cleaning process and is not limited to use in connection with embodiments of the cleaning process described above.

In a preferred embodiment of the solvent recovery process, contaminated organic solvent is first separated from solids and/or base waters. Contaminated organic solvent used in a heat exchanger tube bundle cleaning process typically contains an amount of solids comprising hydrocarbon deposits that either were not suspended in the organic solvent or did not remain suspended in the organic solvent. Additionally, many of the hydrocarbon deposits typically found on heat exchanger tube bundles include encapsulated water molecules. Therefore, when the hydrocarbon deposits soften and/or become suspended in the organic solvent, these base waters are released. Accordingly, contaminated organic solvent will often also contain water molecules or base waters. It is desirable to remove these solids and/or base waters early in the organic solvent recovery process.

By using an organic solvent that is less dense than water (i.e. the organic solvent has a specific gravity of less than one), the contaminated organic solvent, when allowed to settle, will separate from base waters. More specifically, the water will drop to the bottom and the less dense organic solvent will rise to the top. Additionally, over time, solids will also settle out of the organic solvent and drop to the bottom. Accordingly, the contaminated organic solvent may be separated from solids and/or base waters by allowing the mixture to separate and collecting only the top portions, which are substantially free of solids and base waters. Preferably, the separation process is performed until the organic solvent contains less than 10% water. More preferably, the separation process is performed until the organic solvent contains less than 2% water.

Because the separation of an organic solvent from solids and/or base waters can be a time-consuming process, the separation is preferably controlled and sped up through the use of multiple separation tanks 204, arranged in series. An example of this system is illustrated in FIG. 7. By configuring the separation tanks 204 so that only the top portion of the organic solvent flows from one tank into the next, such as by forcing the solvent to flow over a weir 205, the solvent in each downstream separation tank 204 contain less base waters and/or solids than the solvent in the previous tank. The use of several separation tanks 204 provides for a continuous separation of the organic solvent from solids and base waters. As contaminated organic solvent is introduced into one end of each separation tank 204, organic solvent containing a lower amount of solids and/or base waters is removed from the other end, so that the solvent level of the tank is kept at a constant. Preferably, the contaminated organic solvent enters the first separation tank 204 through a diffuser 207, which breaks up the flow of the solvent, thereby providing a slow diffusion of the solvent into the tank, and a more stable settling time.

The separation may be further controlled and sped up through the use of a series of knock-out plates 206. The knock-out plates 206 may be contained in one or more of the separation tanks 204 through which the organic solvent is passed. As the solvent in a tank 204 slowly moves downstream, it must pass through the series of knock-out plates 206, each of which allows the lighter organic solvent to flow over the top of each knock-out plate at a higher rate than the heavier base waters and/or solids. Thus, as the organic solvent progresses over the series of knock-out plates 206, it is continuously separated from solids and/or base waters. Preferably, the knock-out plates 206 are set at a slight grade, such as about ten degrees, with the top of each plate being slightly further upstream than the bottom. This forces the solids and/or waters to fall out in a downstream direction, increasing the effectiveness of the separation. The knock-out plates 206 are also preferably spaced apart in even increments to provide maximum efficiency.

Preferably, each of the one or more separation tanks 204 also has a cone-shaped bottom 208. The cone-shaped bottom 208 operates to direct the solids and waters to an opening at the bottom of the cone from which they may easily be removed from the tank 204, such as through a suction pipe 209.

In a preferred embodiment, the contaminated organic solvent may be separated from solids and base waters by the system illustrated in FIG. 7. This process involves a first treatment in a separation tank 204 having a series of knock-out plates 206. This first treatment removes a large percentage of the solids. Then, the organic solvent is further separated from solids and base waters by its passage through a series of three additional separation tanks 204. When d-limonene is used as the organic solvent, for example, up to 2,000 liters per minute may typically be treated using this separation process to yield a product that contains less than 2% base waters.

This same process may typically be used to achieve a desired separation for any of the preferred organic solvents. For example, an organic solvent having a density closer to that of water (i.e. a specific gravity close to one) will require a longer time to separate. To ensure a desired degree of separation with a denser organic solvent, therefore, one would simply lower the flow rate of the solvent through the separation process. If a slower flow rate alone would not provide the desired degree of separation, or if a slower flow rate was undesirable, one could increase the number of knock-out plates 206 and/or the size or number of separation tanks 204 in order to achieve a desired flow rate of a product having a desired purity.

In another embodiment of the solvent recovery process, the contaminated organic solvent is fed into a distillation unit 210, where the more volatile organic solvent is boiled off and separated from the less volatile suspended hydrocarbons. In a preferred embodiment of the solvent recovery process, the contaminated organic solvent is separated from solids and/or base waters, such as described above, before being fed to a distillation unit 210.

In the distillation column 211, the organic solvent containing suspended hydrocarbons is heated to a temperature at which the organic solvent is boiled off and separated from the hydrocarbon contaminants. The purified organic solvent coming off the top of the distillation column 212 is then recaptured by condensing it back to its liquid form. By control of the distillation process, the organic solvent exiting the distillation unit 210 can be rendered substantially free of suspended hydrocarbons. This purified organic solvent may then be reused in the bundle cleaning process. An example of the distillation process is illustrated in FIG. 8.

The amount of purified organic solvent recovered from the distillation process depends on the properties of the particular organic solvent being used. For example, when d-limonene is used as the organic solvent, at least 98% of the d-limonene is recovered from a single pass through the distillation column 211. The remaining 2%, which remains bonded to hydrocarbons, could be separated by additional passes through the distillation column 211; however, because of the minimal return, it is not efficient to do so. Other preferred organic solvents may be more difficult to separate from the suspended hydrocarbons. Thus, depending on the organic solvent selected, it may be desirable to pass the contaminated organic solvent through the distillation column 211 multiple times in order to recover a desirable amount of purified organic solvent.

Preferably, at least 90% of the organic solvent fed into the distillation process is recovered as a purified organic solvent. More preferably at least 95% of the organic solvent is recovered from the distillation process as a purified organic solvent. Most preferably, at least 98% of the organic solvent is recovered from the distillation process as a purified organic solvent.

Some of the preferred organic solvents comprise a number of different organic constituents, each of which may separate from the suspended hydrocarbons in the distillation column 211 to different degrees. The result may be a purified organic solvent having a composition that differs somewhat from the originally selected organic solvent. Accordingly, in some embodiments, it will be desirable to blend the purified organic solvent exiting the distillation column 211 with fresh amounts of one or more of the particular constituents of the original organic solvent in order to more closely match the composition of the purified organic solvent with the composition of the originally selected organic solvent.

In another embodiment of the solvent recovery process, a mixture of hydrocarbons is separately collected as the bottoms of the distillation process 213. Typically, because some amount of organic solvent remains bonded to the hydrocarbons that are collected as the bottoms of the distillation process 213, the viscosity of this mixture is lowered. Additionally, because the organic solvent does not include chemicals such as surfactants and the like, the organic solvent that remains in the bottoms need not be separated for the hydrocarbons to be put through a refining process. Accordingly, the hydrocarbon stream collected from the distillation process 213, or at least a large portion thereof, may itself be used as refinable oil.

In a preferred embodiment, the hydrocarbon stream collected from the bottoms of the distillation process is separated into light and heavy fractions. The light fractions of the hydrocarbon stream may be collected to produce an enhanced recovery oil product. This separation may be performed by allowing the mixture to separate by gravity, such as by settling in an enhanced recovery oil tank 219.

Although the heavier fractions may need to be disposed, the lighter oils that rise to the top of the enhanced oil recovery tank 219 may be collected and used for further refinement. As these useful oils may typically constitute greater than ninety-five percent of the hydrocarbon mixture, this process can yield a significant amount of useful enhanced recovery oil. As such, hydrocarbon waste may be greatly reduced.

In another preferred embodiment of the solvent recovery process, contaminated organic solvent is conveyed to a storage tank 223, from which it can be sent either to a distillation unit 210 or to the cleaning chamber 101. Preferably, the contaminated organic solvent is separated from solids and base waters, such as in a separation unit 203, before being sent to the storage tank 223. See, for example, FIG. 6.

Figure 6:
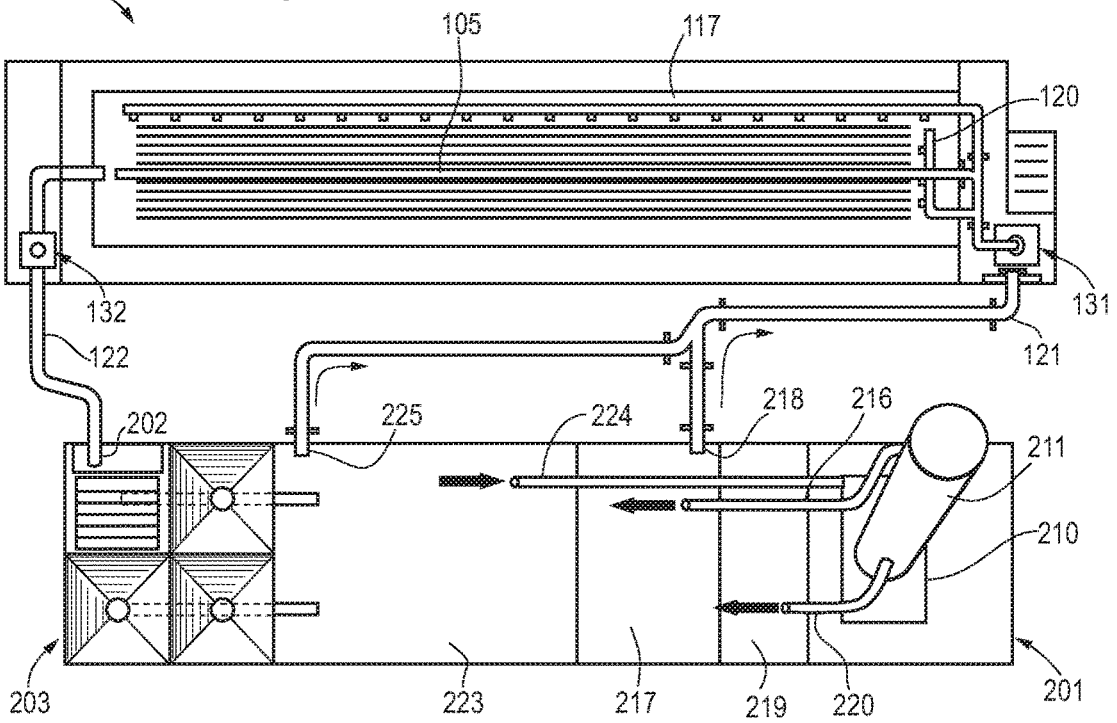
FIG. 6 is a top plan view, partly in perspective, of an embodiment of a heat exchanger tube bundle cleaning system comprising a cleaning chamber and an organic solvent recovery unit.

Preferably, the suspended hydrocarbon content of the organic solvent in the storage tank 223 is monitored. The organic solvent in the storage tank 223 is conveyed to the cleaning chamber 101 for use in the bundle cleaning process until the suspended hydrocarbon content reaches a certain, predetermined level. When the suspended hydrocarbon content reaches that predetermined level, the organic solvent in the storage tank 223 is conveyed to the distillation unit 210 rather than to the cleaning chamber 101. After the organic solvent is treated by distillation to remove the suspended hydrocarbons, the purified organic solvent may then be conveyed to the cleaning chamber 101 for use in the bundle cleaning process or to a purified organic solvent tank 217, as illustrated in FIG. 6.

The level of suspended hydrocarbons at which a particular organic solvent is sent to the distillation unit 210 of the recovery process will depend on the ability of that organic solvent to continue to solubilize hydrocarbons. This may be determined by analyzing the effectiveness of the organic solvent at various levels of saturation. For example, d-limonene, a preferred organic solvent, can reach saturation levels of up to about 30% by weight hydrocarbons. However, when the suspended hydrocarbon content of the d-limonene organic solvent reach about 20% by weight, its effectiveness in solubilizing hydrocarbons decreases to the point where it becomes desirable to send the d-limonene to the distillation unit 210 before reusing it in the bundle cleaning process.

Alternatively, the storage tank 223 may be bypassed and the contaminated organic solvent may continuously be sent to the distillation unit 210 prior to being reused in the bundle cleaning process. This may be desirable where the organic solvent is quickly saturated with hydrocarbons from the bundle cleaning process, either as a result of the solvent having a low saturation point or of the bundle having a particularly heavy amount of contamination or both.

Vapor Recovery Process

In another embodiment of the present invention, the organic solvent that is vaporized in a heat exchanger tube bundle cleaning process is treated in a vapor recovery process and the recovered solvent is then reused in a bundle cleaning process. The vapor recovery process may be performed on vaporized organic solvent from any heat exchanger tube bundle cleaning process and is not limited to use in connection with any of the preferred embodiments described above.

In a preferred embodiment of the vapor recovery process, the mixture of process gas and vaporized organic solvent removed from the cleaning chamber 101, such as by one or more gas outlets 115, is conveyed to a vapor recovery process. During the vapor recovery process, the gas mixture is cooled and compressed, so as to selectively condense the organic solvent and separate it from the process gas. The condensed organic solvent is then conveyed to the cleaning chamber 101 for reuse in the heat exchanger tube bundle cleaning process. Preferably, over 90% of the vaporized organic solvent is recovered, as reusable liquid organic solvent, from the gas mixture. More preferably, over 95% of the vaporized organic solvent is recovered from the gas mixture.

Any number of cooling and compressing steps may be used in order to achieve the desired degree of condensation of the organic solvent. The exact combination of steps will depend on the properties of the organic solvent being recovered. For example, a significant amount of d-limonene may be recovered by a process that comprises first cooling the gas mixture to condense a first amount of the d-limonene, followed by compressing the gas mixture to an elevated pressure, and then again cooling the gas mixture to condense a second amount of the d-limonene. An example of a vapor recovery process that may be used for the recovery of d-limonene is illustrated in FIG. 9.

Using this process, for example, a gas mixture of nitrogen process gas and d-limonene may be cooled via a first heat exchanger 302 to about 20° C., thereby condensing a first amount 305 of the d-limonene, which is collected and pumped back to the cleaning chamber 101. The resulting gas mixture is then sent to a compressor 303, where it is compressed to an elevated pressure between about 3,000 mm Hg and about 3,800 mm Hg. The compressed gas mixture is then cooled, such as via a second heat exchanger 304, to about 20° C., to thereby condense a second amount of the d-limonene 306, which is also collected and pumped back to the cleaning chamber 101. Using this process, over 95% of the vaporized d-limonene may be recovered from the gas mixture and returned as organic solvent to the heat exchanger tube bundle cleaning process.

Selection of an Organic Solvent

The organic solvent to be used for cleaning a heat exchanger tube bundle 1 in accordance with embodiments of the present invention may be specifically selected based on the properties of the organic solvent and the profile of hydrocarbon contaminants on the bundle being treated. Preferred properties of the organic solvent include the capacity to effectively remove heavy hydrocarbons and bitumen, the ability to solubilize hydrocarbons, a high saturation point, an appropriate flash point, and the capacity to be efficiently and cost-effectively separated from suspended hydrocarbons by distillation. Depending on the profile of the hydrocarbon contaminants for a particular heat exchanger bundle or set of bundles, some of these properties may become more or less important.

D-limonene is a preferred organic solvent for embodiments of the present invention. D-limonene is a terpene that can reach saturation levels of hydrocarbons up to about 30% by weight and can be easily be distilled to recover over 98% of the d-limonene. Accordingly, d-limonene is an ideal organic solvent for the cleaning of many heat exchanger tube bundles, especially those having hydrocarbon deposits that do not comprise large amounts of the heaviest bitumen and similar heavy contaminants. However, d-limonene has a relatively low flash point of about 43° C. Thus, where higher temperatures are desirable, such as to remove heavier hydrocarbon contaminants, an organic solvent having a higher flash point may be desirable.

In general, organic solvents that are considered to have a desirable combination of properties may be selected from the following: alkylated aromatics (including alkylates), aliphatic hydrocarbons, unsaturated hydrocarbons (such as olefinic hydrocarbons and cyclic hydrocarbons), esters (including aromatic esters, fatty esters, and other unsaturated esters), ethers (including aromatic ethers, fatty ethers, and other unsaturated ethers), halogenated hydrocarbons, heterocyclic hydrocarbons, heteroatom containing hydrocarbons, and combinations thereof. By selecting an organic solvent that is customized for treatment of a particular contaminant profile, the present invention provides a process that can be specifically tailored to provide maximum efficiency at the lowest cost.

On-Site Cleaning

The method and system for cleaning a heat exchanger tube bundle 1 according to embodiments of the present invention may also be performed on-site. This may be particularly useful where the heat exchanger tube bundle 1 may not be taken off-line for a length of time to allow transport or where unplanned cleaning is required due to heavy contamination.

For example, a cleaning chamber 101 may be mounted on a trailer, which, along with a supply of organic solvent, can be taken to a job site. The supply of organic solvent may comprise, for example, a tanker truck. The organic solvent is then pumped from the supply to the cleaning chamber 101, where it can be used to remove hydrocarbon deposits from a heat exchanger tube bundle 1 as described above. In one preferred embodiment, the contaminated organic solvent can be filtered to remove solids, and simply pumped back to the supply.

More preferably, however, recovery of the contaminated organic solvent may also be performed on-site. For example, an organic solvent recovery unit 201 may also be mounted on a trailer and taken to a job site. Accordingly, solids and/or base waters may be separated from the organic solvent using the methods described above. For instance, before being pumped back to the supply, contaminated organic solvent may be conveyed through a separation unit 203 such as that illustrated in FIG. 7. In some instances, the organic solvent may also be treated to remove soluble hydrocarbons by distillation on-site. However, in other instances, it may be desirable to perform the distillation stage 210 of the organic solvent recovery process at a fixed location off-site. By treating the contaminated organic solvent so as to render it suitable for reuse in the cleaning of a heat exchanger tube bundle 1, solvent recovery provides for the on-site cleaning of a heat exchanger bundle or bundles that permits a smaller supply of organic solvent to be taken to the job site.

It can be seen that the described embodiments provide unique and novel methods and systems for removing hydrocarbon deposits from a heat exchanger tube bundle 1 that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A heat exchanger tube bundle cleaning system comprising:

a cleaning chamber comprising a base defining a reservoir containing an organic solvent and a hinged lid;

a cradle configured to support a heat exchanger tube bundle in the reservoir, the cradle comprising one or more rollers configured to rotate the heat exchanger tube bundle;

a shell-side spraying system configured to spray a pressurized stream of organic solvent against a shell-side surface of the heat exchanger tube bundle;

a heating element configured to raise or lower the temperature of the organic solvent;

wherein the floor of the cleaning chamber is sloped downward from the side walls of the base to a recess in the center of the reservoir and wherein an auger runs along the recess.

2. The heat exchanger tube bundle cleaning system of claim 1, further comprising a tube-sheet spraying system configured to spray a pressurized stream of organic solvent into the individual tubes of the heat exchanger tube bundle while the heat exchanger tube bundle is within the reservoir.

3. The heat exchanger tube bundle cleaning system of claim 2, wherein the tube-sheet spraying system comprises one or more nozzles configured to travel across the tube sheet of the heat exchanger tube bundle.

4. The heat exchanger tube bundle cleaning system of claim 1, wherein the underside of the lid comprises a rinsing manifold configured for spraying liquid along the length of the heat exchanger tube bundle.

5. The heat exchanger tube bundle cleaning system of claim 1, wherein the cradle comprises one or more telescoping members that provide the cradle with an adjustable length, an adjustable width, or a combination thereof.

6. The heat exchanger tube bundle cleaning system of claim 5, wherein the one or more telescoping members are configured so that the location of the rollers within the reservoir is adjustable.

7. The heat exchanger tube bundle cleaning system of claim 1, wherein the shell-side spraying system comprises an isolation valve configured to limit the spraying of organic solvent to a desired length within the reservoir.

8. The heat exchanger tube bundle cleaning system of claim 1, further comprising a lifting system operably connected to the cradle and configured to raise the cradle out of the reservoir and lower the cradle into the reservoir.

9. The heat exchanger tube bundle cleaning system of claim 8, wherein the lifting system comprises at least a first one or more hydraulic cylinders and a second one or more hydraulic cylinders, wherein the first one or more hydraulic cylinders and the second one or more hydraulic cylinders are configured to operate independently so that the cradle may be brought to an inclined position to allow for draining of the organic solvent from the heat exchanger tube bundle back into the reservoir for reuse and/or recycle.

10. The heat exchanger tube bundle cleaning system of claim 1, further comprising a series of gas inlets configured to carry a gas evenly across the surface of the reservoir.

11. The heat exchanger tube bundle cleaning system of claim 10, further comprising a series of gas outlets configured to extract vapors across the surface of the reservoir, the series of gas outlets being located on an opposite side of the reservoir from the series of gas inlets.

12. The heat exchanger tube bundle cleaning system of claim 1, further comprising an organic solvent recovery unit comprising i. a separation unit configured to separate solids, base waters, or both from contaminated organic solvent; and ii. a distillation unit having a tops outlet from which a purified organic solvent fraction is withdrawn and a bottoms outlet from which hydrocarbon contaminants are withdrawn.

13. The heat exchanger tube bundle cleaning system of claim 12, wherein the system is configured so that organic solvent can be circulated between the cleaning chamber and the organic solvent recovery unit.

14. The heat exchanger tube bundle cleaning system of claim 12, wherein the separation unit comprises a plurality of knock-out plates.

15. The heat exchanger tube bundle cleaning system of claim 1, wherein the cradle comprises a plurality of rollers; and wherein the rollers are driven with independent hydraulic motors.

16. A heat exchanger tube bundle cleaning system comprising:

a cleaning chamber comprising a base defining a reservoir containing an organic solvent and a hinged lid;

a cradle configured to support a heat exchanger tube bundle in the reservoir, the cradle comprising one or more rollers configured to rotate the heat exchanger tube bundle;

a shell-side spraying system configured to spray a pressurized stream of organic solvent against a shell-side surface of the heat exchanger tube bundle;

a heating element configured to raise or lower the temperature of the organic solvent;

a lifting system operably connected to the cradle and configured to raise the cradle out of the reservoir and lower the cradle into the reservoir, wherein the lifting system comprises at least a first one or more hydraulic cylinders and a second one or more hydraulic cylinders, the first one or more hydraulic cylinders and the second one or more hydraulic cylinders being configured to operate independently so that the cradle may be brought to an inclined position to allow for draining of the organic solvent from the heat exchanger tube bundle back into the reservoir for reuse and/or recycle.

17. The heat exchanger tube bundle cleaning system of claim 16, further comprising a tube-sheet spraying system configured to spray a pressurized stream of organic solvent into the individual tubes of the heat exchanger tube bundle while the heat exchanger tube bundle is within the reservoir.

18. The heat exchanger tube bundle cleaning system of claim 16, wherein the underside of the lid comprises a rinsing manifold configured for spraying liquid along the length of the heat exchanger tube bundle.

* * * * *